US005890262A

United States Patent [19]

Orozco

[11] Patent Number: 5,890,262

[45] Date of Patent: Apr. 6, 1999

[54] ADJUSTABLE PIVOT HINGE WITH CAM ACTION

[76] Inventor: Alfonso C. Orozco, 967 Salerno Dr., Campbell, Calif. 95008

[21] Appl. No.: 862,154

[22] Filed: May 22, 1997

[51] Int. Cl.[6] ..... E05D 7/06

[52] U.S. Cl. ..... 16/239; 16/235

[58] Field of Search ..... 16/239–242, 235, 16/243–246

[56] References Cited

U.S. PATENT DOCUMENTS

| | | | |
|---|---|---|---|
| 1,044,055 | 11/1912 | Johnson et al. | 16/239 |
| 1,336,174 | 4/1920 | Way | 16/239 |
| 1,540,581 | 6/1925 | Way | 16/239 |
| 1,949,183 | 2/1934 | Roberts | 16/239 |
| 2,688,779 | 9/1954 | Westman | 16/240 |
| 3,545,031 | 12/1970 | Dielman | 16/153 |
| 3,545,032 | 12/1970 | Dielman | 16/153 |
| 4,493,129 | 1/1985 | Grass | 16/238 |
| 4,494,275 | 1/1985 | Hsi-Shan | 16/314 |
| 4,790,106 | 12/1988 | La See | 16/240 |
| 5,029,362 | 7/1991 | Prodan | 16/236 |
| 5,406,748 | 4/1995 | Davlantes | 49/169 |
| 5,689,855 | 11/1997 | Tang | 16/235 |

FOREIGN PATENT DOCUMENTS

| | | | |
|---|---|---|---|
| 1137878 | 12/1968 | United Kingdom | 16/242 |

*Primary Examiner*—Chuck Y. Mah

*Attorney, Agent, or Firm*—Skjerven, Morrill, MacPherson, Franklin Friel LLP; David E. Steuber

[57] ABSTRACT

A hinge has a cam having a securing mechanism for optionally affixing the cam to an object. The cam is rotatably coupled to the object along a first axis when the securing mechanism is not affixing the cam to the object. The hinge has a rotatable coupling mechanism to rotatably couple the cam to another object along an axis approximately parallel to, but offset from, the first axis. This invention provides the advantage of aligning two objects without requiring an exact initial positioning of the coupling mechanisms with respect to the two objects. Furthermore, the present invention allows for alignment without requiring multiple alignment attempts.

3 Claims, 6 Drawing Sheets

ADJUSTABLE PIVOT HINGE WITH CAM ACTION

FIELD OF THE INVENTION

This invention relates to alignment technology and in particular to a mechanical alignment hinge using a cam.

BACKGROUND

There currently is a strong demand for devices and methods for aligning one object relative to another. For example, in cabinet construction, aligning the cabinet door (hereafter "door") so that it is flush with the surrounding cabinet is important. This flush alignment provides improved functional and aesthetic value to the cabinet.

One prior art method of aligning a cabinet door to be flush with the cabinet is the simple trial and error method. First, a rough estimate is made as to the required position of the intended coupling mechanism (e.g., hinge) on the cabinet and door. The door is then coupled to the cabinet using the hinge. This typically requires the preparation of the door and cabinet for the receipt of a nail or screw for fastening the hinge to each of the door and hinge. If the door is not flush after the first installation, the door is removed and the process repeats itself. This process had the disadvantage of being time consuming if repeating the process is necessary. Furthermore, repeated connections can be damaging to the cabinet and door material and is typically not aesthetically pleasing.

One prior art method for overcoming some of these disadvantages is to refine the estimate of the required initial position of the hinge that would allow for a flush alignment. However, this refined estimate also requires time. Therefore, what is desired is an alignment device and method that does not require an exact initial positioning of the hinge on each of the door and cabinet in order to obtain a flush alignment of the door to the cabinet. Furthermore, what is desired is a device that does not require repeating the installation of the door to the cabinet in order to obtain a flush alignment.

SUMMARY OF THE INVENTION

In accordance with the principles of this invention, a hinge is provided. The hinge has a cam and a securing mechanism for optionally affixing the cam to an object. The cam is rotatably coupled to the object along a first axis when the securing mechanism is not affixing the cam to the object. The hinge has a rotatable coupling mechanism to rotatably couple the cam to another object along an axis approximately parallel to, but offset from, the first axis. In one embodiment, the cam is mounted in a hole bored in a cabinet door and the door is rotatably secured to a frame surrounding the door.

This invention provides the advantage of aligning two objects without requiring an exact initial positioning of the coupling mechanisms with respect to the two objects. Furthermore, the present invention allows for alignment without requiring multiple alignment attempts.

DETAILED DESCRIPTION OF THE PREFERRED EMBODIMENTS

While embodiments of this invention will be described below, those skilled in the art will recognize that other structures and methods are capable of implementing the principles of this invention. Thus the following description is illustrative only and not limiting.

Figure 1A:
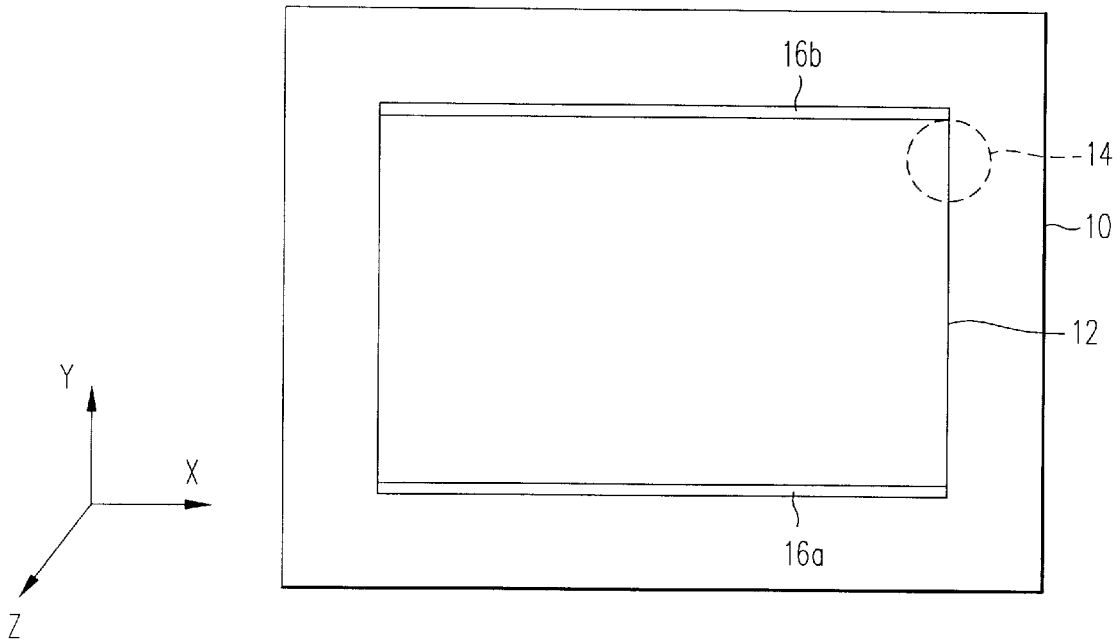
FIG. 1A illustrates a front view of a cabinet and door assembled according to the principles of the present invention.
Figure 1B:
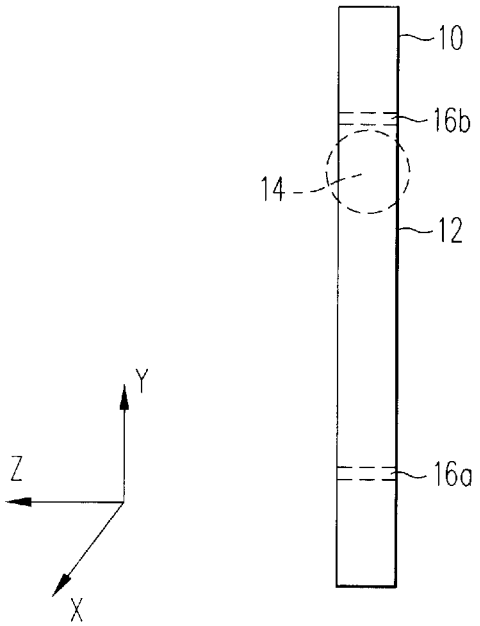
FIG. 1B illustrates a side view of a cabinet and door assembled according to the principles of the present invention.

FIG. 1A illustrates a front view of a cabinet and door assembly according to the principles of the present invention. Furthermore, FIG. 1B illustrates a side view of a cabinet and door assembled according to the principles of the present invention. The cabinet and door assembly comprises a cabinet door frame 10, a door 12 and a hinge 14.

Hereafter, the x, y, and z axis will be referred to with reference to the axis system illustrated in FIGS. 1A and 1B. Furthermore, "x-direction" will be used to describe directions parallel to the x-axis (parallel to the surface of cabinet door frame 10 and the lengths of gaps (16A, 16B)). "y-direction" will be used to describe directions parallel to the y-axis (parallel to the surface of cabinet door frame 10 and perpendicular to the lengths of gaps (16A, 16B)). "z-direction" will be used to describe directions parallel to the z-axis (perpendicular to the surface of cabinet door frame 10).

The surface of door 12 is aligned to be flush in the z-direction with the surface of cabinet door frame 10 as seen from FIG. 1B. Furthermore, door 12 is aligned in the y-direction such that gaps 16*a* and 16*b* have desired widths. In one embodiment the width of one or both of gaps 16*a* and 16*b* is negligible.

Door 12 and cabinet door frame 10 are coupled together with hinge 14 which is only generally shown in FIGS. 1*a* and 1*b*. Hinge 14 is a cam action hinge adjustable in the y-direction and the z-direction. The hinge comprises a plate and a cam, the function and structure of each will be described hereinafter.

Figure 2B:
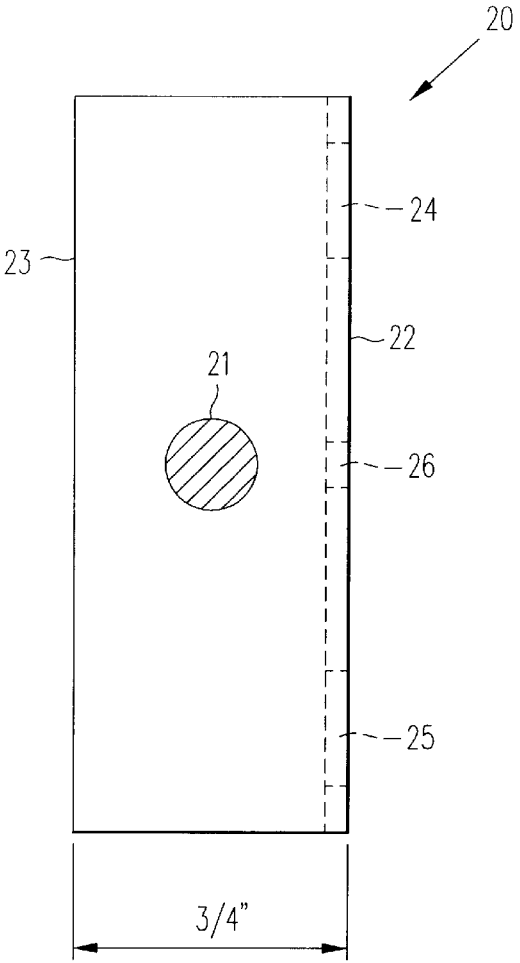
FIG. 2B illustrates a side view of the plate used in conjunction with the alignment device according to the first embodiment of the invention.
Figure 2A:
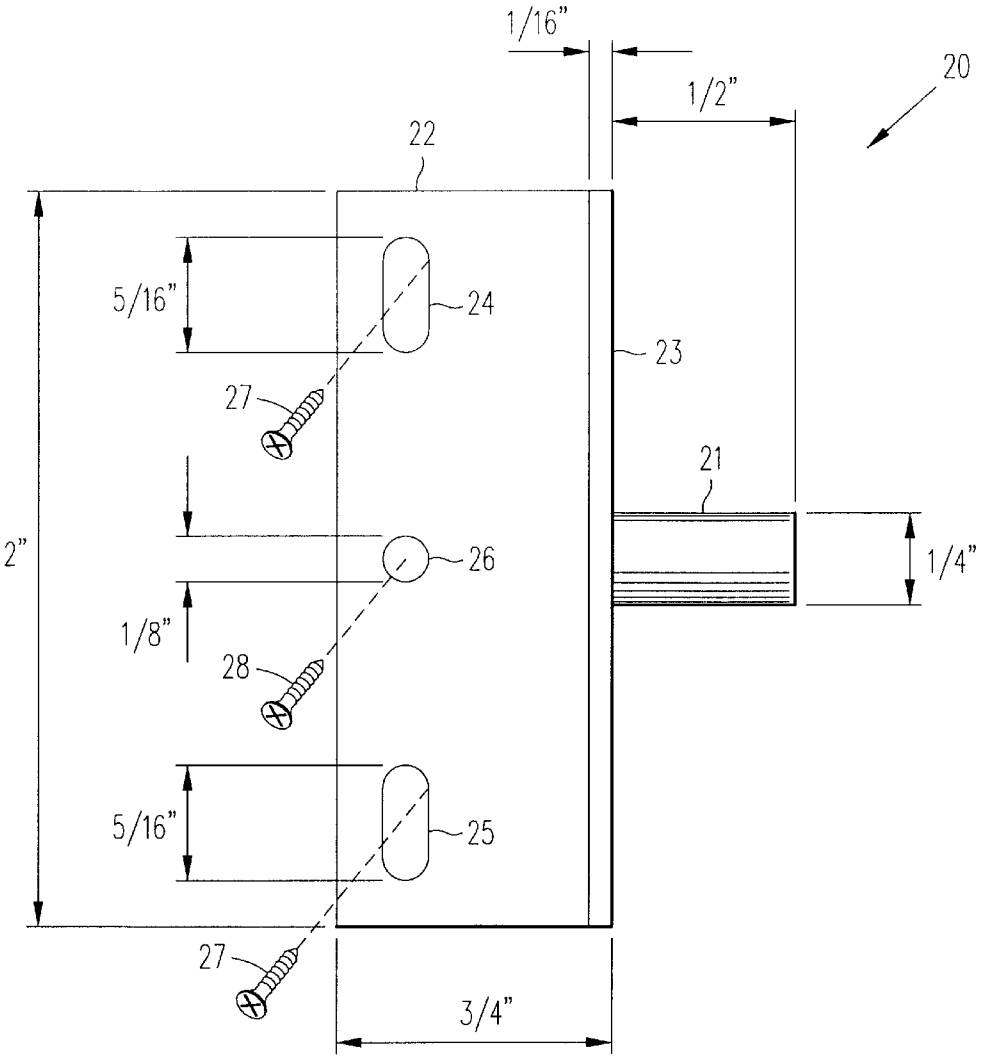
FIG. 2A illustrates a front view of a plate used in conjunction with the alignment device according to a first embodiment of the invention.
Figure 2C:
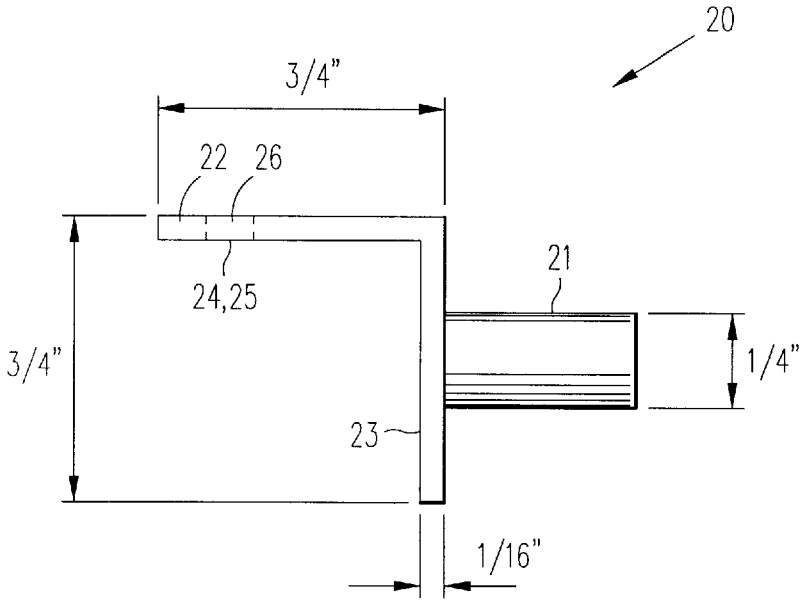
FIG. 2C illustrates a top view of the plate used in conjunction with the alignment device according to the first embodiment of the invention.

FIGS. 2A, 2B, and 2C illustrate a front view, side view, and top view, respectively, of a plate used in conjunction with the alignment device according to a first embodiment of the invention. Plate 20 is one of two parts of hinge 14. A cam 40 (shown in FIGS. 4A, 4B, 5A and 5B) is the other part of hinge 14 and is coupled to door 12 in a manner described in detail hereinafter. The function of plate 20 is to provide a means of coupling cam 40, and hence door 12, to cabinet door frame 10 and to provide a means of adjusting the alignment of door 12 in the y-direction with respect to cabinet door frame 10.

Plate 20 is an angled plate having an extension 21, a first portion 22 and a second portion 23. Furthermore, first portion 22 has elongated holes 24 and 25 and a hole 26. Second portion 23 is perpendicular to first portion 22 and extension 21 protrudes from a side of second portion 23. First portion 22 abuts a front or back surface of cabinet door frame 10. Second portion 23 abuts an inside surface of cabinet door frame 10 next to door 12. A fastener such as screws 27 are inserted through each of elongated holes 24 and 25 and into cabinet door frame 10. Hinge 14 is adjusted in the y-direction by sliding plate 20 along the y-axis to the correct alignment and then tightening plate 20 to cabinet door frame 10. At this point, another screw 28 is inserted through hole 26 and into cabinet door frame 10 to further secure plate 20 to cabinet door frame 10.

Figure 3A:
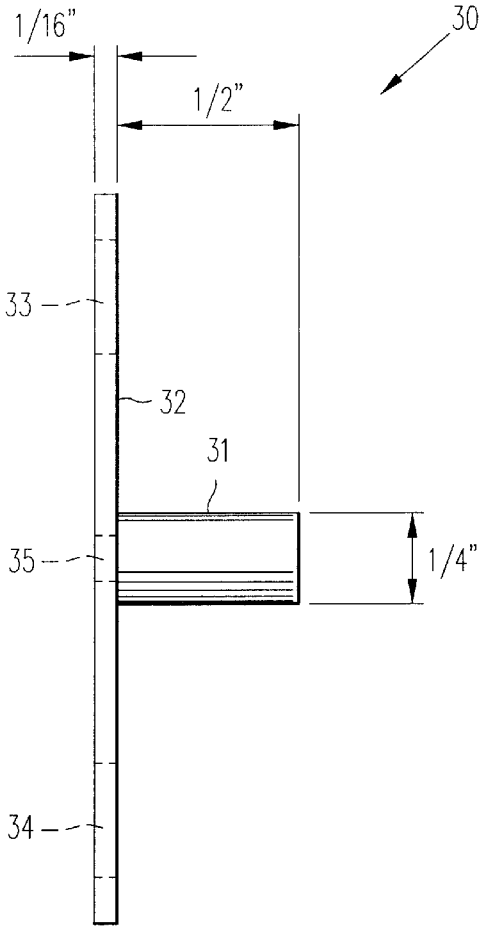
FIG. 3A illustrates a front view of a plate used in conjunction with the alignment device according to a second embodiment of the invention.
Figure 3B:
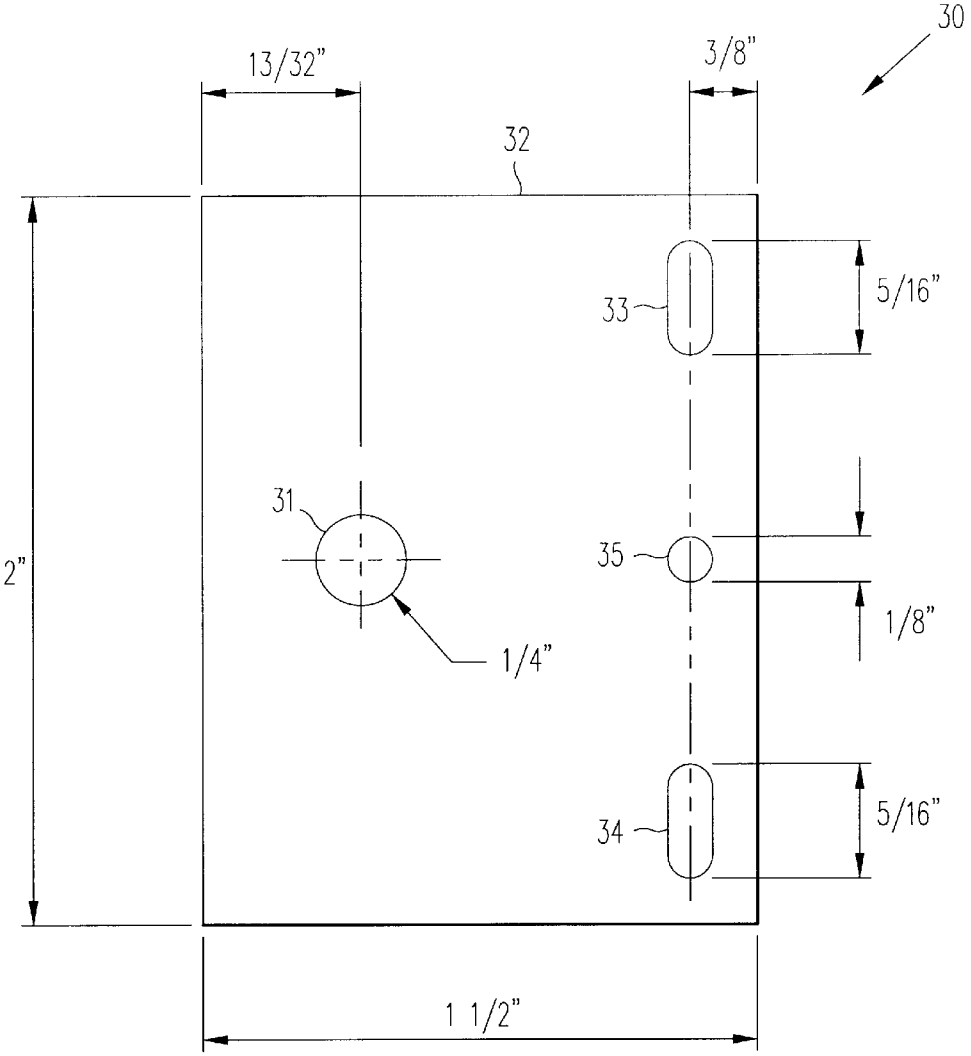
FIG. 3B illustrates a side view of the plate used in conjunction with the alignment device according to the second embodiment of the invention.

FIGS. 3A and 3B illustrate a side view and front view, respectively, of a plate used in conjunction with the alignment device according to a second embodiment of the invention. Plate 30 is also one of two parts of hinge 14. Cam 40 is the other part of hinge 14. The function of plate 30 is to provide a means of coupling cam 40, and hence door 12, to cabinet door frame 10 and to provide a means of adjusting the alignment of door 12 in the y-direction with respect to cabinet door frame 10.

Plate 30 is a flat plate having an extension 31 and a portion 32. Furthermore, portion 32 has elongated holes 33 and 34 and a hole 35. Portion 32 abuts an inside surface of cabinet door frame 10 next to door 12. A fastener such as a screw (not shown) is inserted through each of elongated holes 33 and 34 and into cabinet door frame 10. Hinge 14 is adjusted in the y-direction by sliding plate 20 along the y-axis to the correct alignment and then tightening plate 30 to cabinet door frame 10. At this point, another screw (not shown) is inserted through hole 35 and into cabinet door frame 10 to further secure plate 30 to cabinet door frame 10.

Figure 4A:
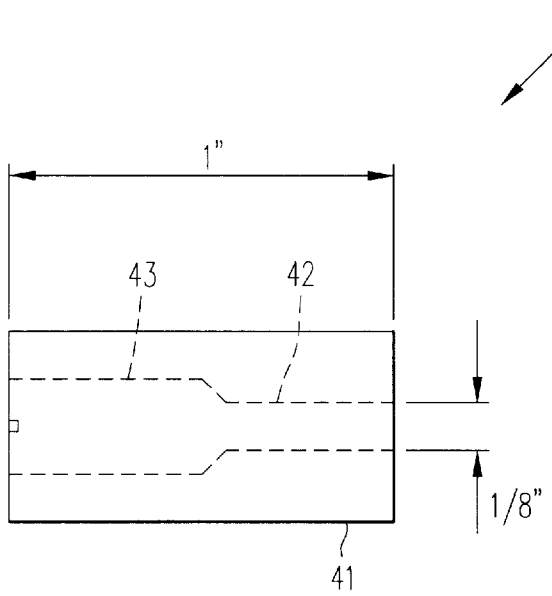
FIG. 4A illustrates a front view of a cam used in conjunction with the alignment device according to one embodiment of the invention.
Figure 4B:
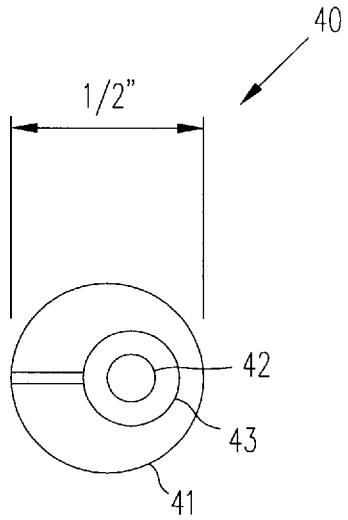
FIG. 4B illustrates an end view of the cam used in conjunction with the alignment device.
Figure 5B:
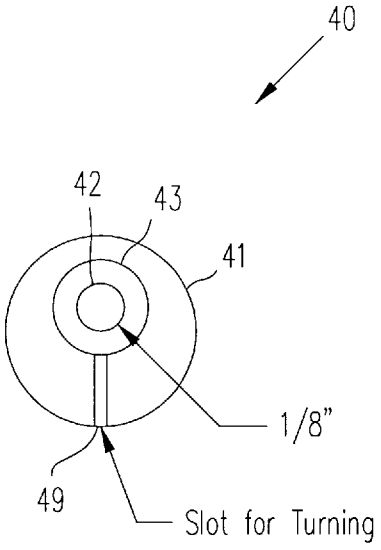
FIG. 5B illustrates an end view of the cam used in conjunction with the alignment device.
Figure 5A:
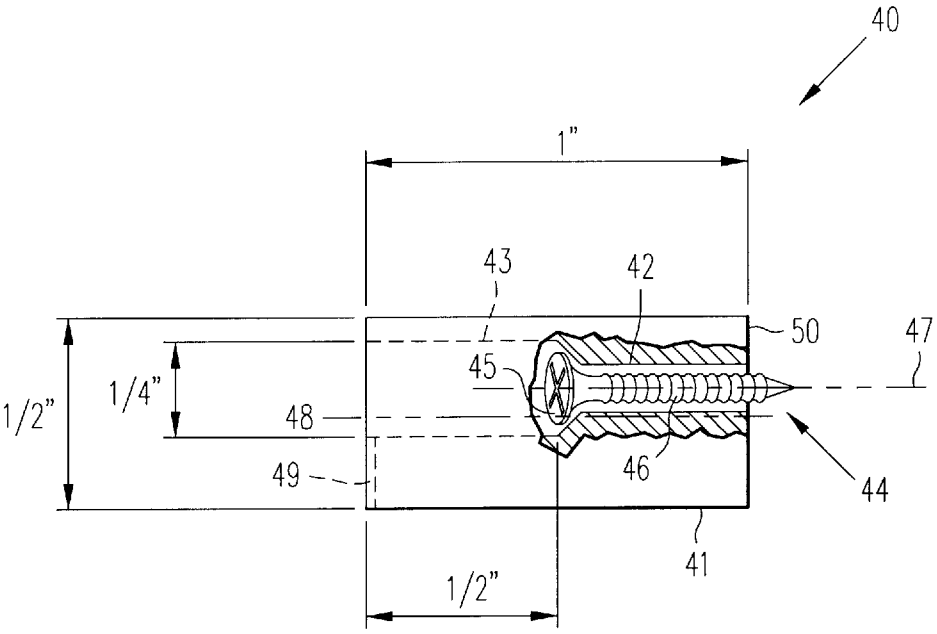
FIG. 5A illustrates a front view of the cam used in conjunction with the alignment device.

FIGS. 4A and 4B illustrate a front view and side view, respectively of a cam used in conjunction with the alignment device according to one embodiment of the invention. Furthermore, FIGS. 5A and 5B illustrate a front view and side view, respectively, of the cam which is turned ninety degrees about the x-axis compared to FIGS. 4A and 4B, respectively.

Cam 40 comprises a cylinder 41 of a diameter of, for example, approximately one half of an inch. A first bore 42 of a diameter of, for example, one eighth of an inch is bored through cylinder 41 so that a center line 47 of first bore 42 is approximately parallel to a central axis 48 of cylinder 41. First bore 42 is bored further so that center line 47 is, for example, spaced one eighth of an inch from central axis 48. In one embodiment, center line 47 of first bore 42 is offset from the central axis 48 of cylinder 41 by a distance which is equal to at least 1/32 of the average diameter of cylinder 41. A second bore 43 of a diameter of, for example, one quarter of an inch is bored through, for example, approximately one half of the length of cylinder 41 along the center line 47 of first bore 42. In this embodiment, first bore 42 is coaxial with second bore 43.

The diameter of first bore 42 is selected such that a portion of a fastener, for example, the threaded shaft 46 of a screw 44, can fit through first bore 42. The diameter of first bore 42 is further selected so that a second portion of a fastener, for example, a head 45 of screw 44, cannot fit through first bore 42. The diameter of second bore 43 is selected such that the second portion or head 45 of screw 44 can fit through second bore 43.

Extension 21 or 31 of respective plates 20 or 30 fits into second bore 43 and is temporarily secured therein using well known methods such as compression fitting. A hole (not shown) is bored along the x-direction into door 12 such that cam 40 fits into the hole of door 12 and is loosely secured therein using well known methods such as compression fitting.

Cam 40 is loosely fit into the hole of door 12 such that when no screw is present in first bore 32, the application of torque from a human source, for example, through a manual screwdriver, causes cam 40 to rotate within the hole of door 12. The cam can be adjusted as the door is installed. Optionally, cam 40 defines a slot 49 in an exposed surface for facilitating the turning of cam 40 with a screwdriver.

Figure 6:
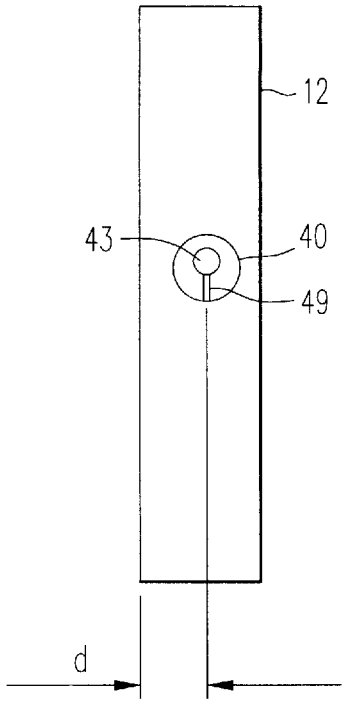
FIGS. 6 and 7 illustrate an end view of the cam installed in the side of the door.
Figure 7:
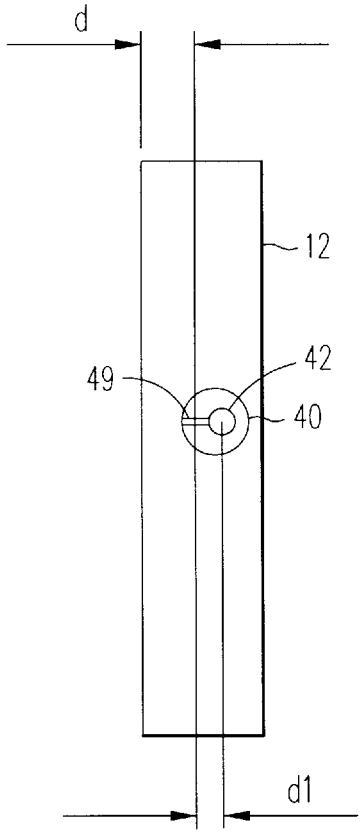

As described above, cam 40 connects door 12 to plate 20 or 30 which, in turn, is mounted to cabinet door frame 10. FIGS. 6 and 7 illustrate an end view of the cam installed in the side of the door. When cam 40 is positioned as shown in FIG. 5B within door 12 as shown in FIG. 6, center line 47 is a distance d from a surface 50 of the door. By turning cam 40 within door 12 such that cam 40 is positioned as shown in FIG. 4B within door 12 as shown in FIG. 7, center line 47 moves further from surface 50 by a distance d1. Thus, by rotating cam 40, door 12 can be moved in the z-direction to be flush with cabinet door frame 10.

The process for alignment is as follows. The process will be described with reference to one hinge and one cam. However, it is apparent that in a typical door, two hinges are needed. In this case, the following process needs to be performed for two hinges. The sequence of the following steps is not relevant except where explicitly stated.

Step 1: a hole is formed in door 12 sized to receive cam 40.

Step 2: extension (21 or 31) of hinge (20 or 30) is inserted into second bore 43 of cam 40.

Step 3: if hinge 20 is used, hinge 20 is positioned such that first portion 22 abuts a front or back surface of cabinet door frame 10 and such that second portion 23 abuts a inside surface of cabinet door frame 10 next to door 12. If hinge 30 is used, hinge 30 is positioned such that portion 32 abuts an inside surface cabinet door frame 10 next to door 12.

Step 4: the alignment of door 12 in the z-direction relative to cabinet door frame 10 is observed.

Step 5: if not properly aligned in the z-direction, cam 40 is turned within the hole of door 12 such that the alignment changes. Note that this may require the removal of hinge (20 or 21) from its position next to cabinet door frame 10 and/or the removal of extension (21 or 31) from second bore 43 or cam 40.

Step 6: repeat steps 2–5 as necessary until correct alignment in the z-direction is observed.

Step 7: after step 6, fasten cam 40 to door 12 by means of screw 44.

Step 8: the alignment of door 12 relative to cabinet door frame 10 in the y-direction is observed.

Step 9: after step 8, door 12 is moved in the y-direction such that when hinges (20 or 30) are correctly positioned as recited in step 3, door 12 is correctly aligned in the y-direction relative to cabinet door frame 10.

Step 10: After step 9, secure hinge (20 or 30) to cabinet door frame 10.

After having reviewed this description, the following alternative embodiments will be rendered obvious to one skilled in the art to which this invention pertains.

First, first bore 42 and second bore 43 and screw 44 are only one mechanism whereby cam 40 is firmly coupled to door 12. This could also be done using other coupling means. As an example, an adhesive material can be disposed between an inside surface 50 of cam 40 and a surface of door 12. After turning cam 40 to the desired position, the material is hardened by, for example, exposure to microwave energy.

Second, slot 49 is used to assist in applying torque to cam 40. However, other methods of applying torque are possible. For example, using a suction cup to grasp cam 40 and turning the suction cup will apply torque to cam 40.

Third, the measurements expressed herein are illustrative only. For example, cam 40 may be thicker or thinner than one half of an inch.

Fourth, the present invention has been described as having cam 40 attached to door 12 and plate 20 or 30 attached to cabinet door frame 10. However, cam 40 may be attached to cabinet door frame 10 and plate 20 or 30 to door 12.

Fifth, extension 21 or 31 is described as extending into second bore 43. It will be apparent that other methods of rotationally coupling plates 20 or 30 to cam 40 in accordance with the principles of the present invention are possible.

Sixth, plates 20 and 30 are described in detail herein. However, other methods of coupling cam 40 to cabinet door frame 10 are possible.

Seventh, plates 20 and 30 do not necessarily need hole 26 or 35. Furthermore, elongated holes 24 and 25 or 33 and 34 are not the only method of adjusting plate 20 or 30 along the y-direction with respect to cabinet door frame 10. For example, gluing plate 20 or 30 is possible, though not necessarily practical.

Eighth, hinge 14 is described for illustrative purposes as connecting door 12 to cabinet door frame 10. However, it is apparent that hinge 14 could be used to align many other objects.

The principles of the present invention are not limited in scope to the described embodiment. Accordingly, other embodiments and variations not described herein may be considered within the scope of my invention as defined by one or more of the following claims.

What is claimed is:

1. An adjustable pivot hinge in combination comprising:

a first object having a cylindrical bore;

a cylindrical cam fitted within said cylindrical bore such that said cam may rotate about a rotational axis within said cylindrical bore when not affixed to said first object, first and second adjacent coaxial bores being formed in said cam, said first and second bores having a substantially common central axis parallel to, but offset from, said rotational axis, said first bore being adjacent said first object;

a screw extending through said first bore and into said first object, said screw having a head that does not fit into said first bore, wherein when said screw is tightened, said head presses said cam against and affixes said cam to said first object; and a second object having a cylindrical extension which fits into said second bore such that said extension is free to rotate about said substantially common central axis.

2. The hinge of claim 1 wherein said first object is a cabinet door and said second object is a cabinet door frame.

3. The hinge of claim 1 wherein said first object is a cabinet door frame and said second object is a cabinet door.

* * * * *